US005467701A

United States Patent [19]

Bartzick et al.

[11] Patent Number: 5,467,701

[45] Date of Patent: Nov. 21, 1995

[54] ARTICLE STRAPPING ARRANGEMENT WITH A SYNCHRONOUS MOTORS CONNECTED TO A FREQUENCY CONVERTER

[75] Inventors: Gerd Bartzick, Gevelsberg; Reinhard Naydowski, Ennepetal; Jürgen Werk, Wuppertal, all of Germany

[73] Assignee: Fried. Krupp AG Hoesch-Krupp, Essen, Germany

[21] Appl. No.: 231,284

[22] Filed: Apr. 22, 1994

[30] Foreign Application Priority Data

Apr. 23, 1993 [DE] Germany ..... 43 13 420.3

[51] Int. Cl.[6] ..... B65B 13/22

[52] U.S. Cl. ..... 100/4; 100/26; 100/29

[58] Field of Search ..... 100/4, 26, 29, 100/33 P B

[56] References Cited

U.S. PATENT DOCUMENTS

| | | | |
|---|---|---|---|
| 3,804,001 | 4/1974 | Longerich et al. | 100/4 |
| 3,946,921 | 3/1976 | Noguchi | 100/26 |
| 4,016,023 | 4/1977 | Takami | 100/33 P B |
| 4,435,945 | 3/1984 | Röhrig | 100/33 P B |
| 5,146,847 | 9/1992 | Lyon et al. | 100/26 |

FOREIGN PATENT DOCUMENTS

| | | | |
|---|---|---|---|
| 2019040 | 10/1979 | United Kingdom | 100/4 |

*Primary Examiner*—Stephen F. Gerrity
*Attorney, Agent, or Firm*—Max Fogiel

[57] ABSTRACT

A package strapper with three motor-driven mechanisms, specifically a strap feed, a strap stretcher, and a strap-end fastener. The mechanisms are mounted on a strap track that loops around the package. The strap feed includes at least two wheels, each forced against one side of the strap by a spring. The motor that drives the strap feed can be reversed. The strap-stretcher wheel is between the feed and the track and is partly loosely surrounded by a strap guide. One end of the guide opens into the track. The strap-feed motor and the strap-stretcher motor are asynchronous three-phase motors. They are connected to a frequency converter that supplies them with electricity of varying frequency and potential and controlled by controls or by a processor integrated into the frequency converter. A manually adjustable terminal strap-tension selector is connected to the controls or to the processor. The frequency of the electricity that powers the strap-stretcher motor is varied in accordance with the prescribed terminal tension. The electricity that powers the strap-feed motor is varied in accordance with frequency and phase.

16 Claims, 2 Drawing Sheets

ARTICLE STRAPPING ARRANGEMENT WITH A SYNCHRONOUS MOTORS CONNECTED TO A FREQUENCY CONVERTER

BACKGROUND OF THE INVENTION

The present invention concerns a package strapper. Three motor-driven mechanisms, specifically a strap feed, a strap stretcher, and a strap-end fastener, are mounted on a strap track. The track loops around the package. The feed includes at least two wheels, each forced against one side of the strap by a spring. The motor that drives the feed can be reversed. The strap-stretcher wheel is between the feed and the track and is partly loosely surrounded by a strap guide. One end of the guide opens into the track.

To ensure high performance on the part of the package strapper, the incoming strap rapidly occupies the entire loop of the track. The strap-feed motor turns off in accordance with a known principle when the leader, the forward end of the strap, that is, encounters a switch at the end of the track. The motor's inertia, however, allows it to feed enough extra strap to jam the track. The motor must accordingly also be mechanically lifted away from the feed wheels by an expensive magnetic clutch, which eventually wears out and must be replaced. Another drawback is that the leader tends to rebound off the switch and buckle the length of strap behind it.

The tensions in the looped strap are evened out in accordance with a known principle. Specifically, the strap-stretcher motor is loosely mounted and, as its reaction increases, forces a spring back slightly against a bearing and engages a switch. The switch turns off the motor and engages a magnetic clutch, which immediately disengages the still spinning motor from the drive. The tension on the spring can be adjusted, and hence the tension in the strap as well. The strap-tension motor accordingly also requires an expensive clutch that wears out. Finally, the spring's bearing against the switch is also complicated.

The object of the present invention is accordingly to improve a package strapper of the aforesaid genus to the extent that the clutch or similar wear-subject component can be eliminated, the leader will not slam against the switch, and the strap-stretcher motor will generate precisely reproducible tension in the strap by strictly electrical means and without any mechanical components that are subject to wear.

BRIEF DESCRIPTION OF THE DRAWINGS

One embodiment of the invention will now be specified by way of example with reference to the accompanying drawing, wherein.

DESCRIPTION OF THE PREFERRED EMBODIMENTS

Figure 1:
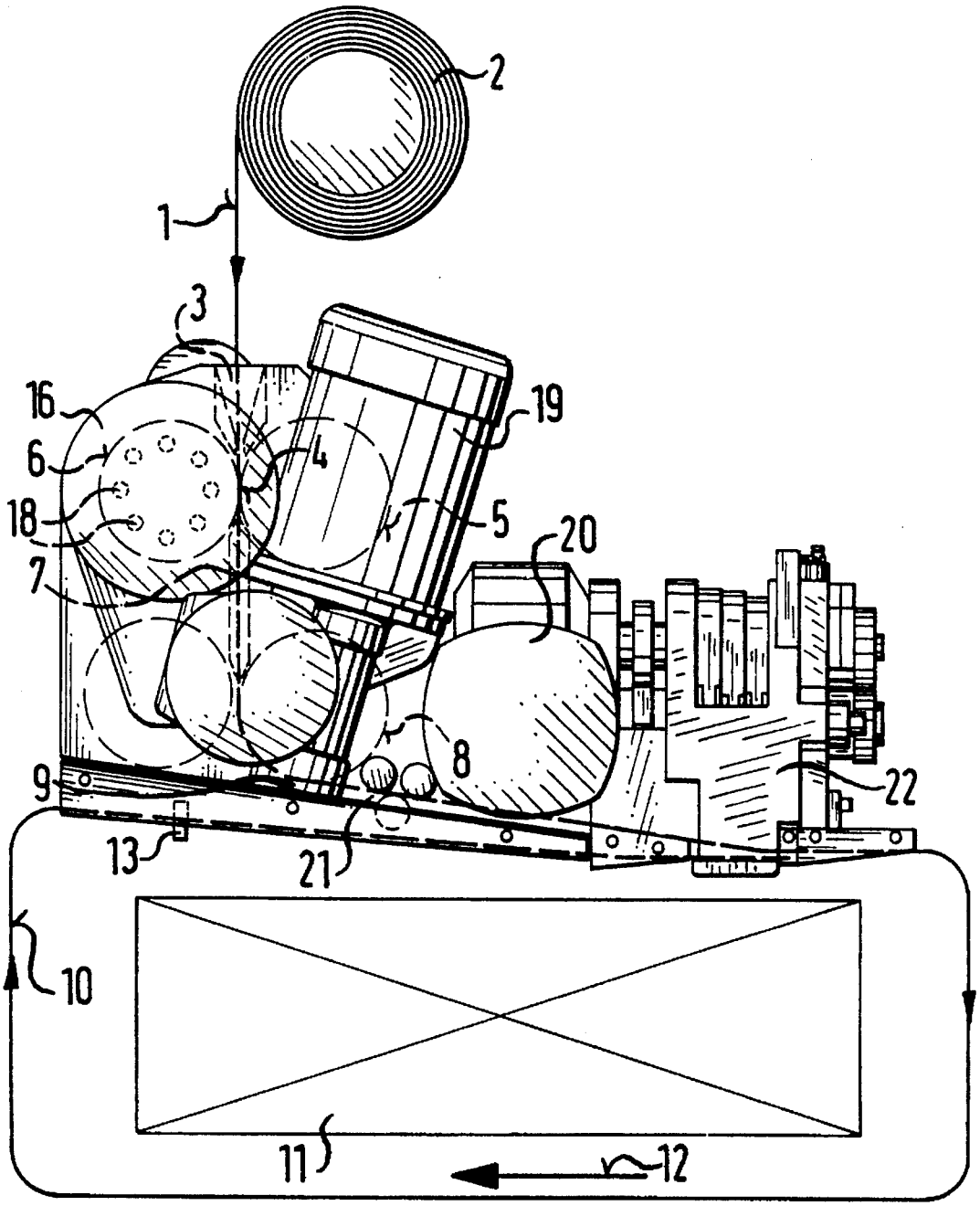
FIG. 1 illustrates the strap feed, the strap stretcher, a supply reel, and the strap track
Figure 2:
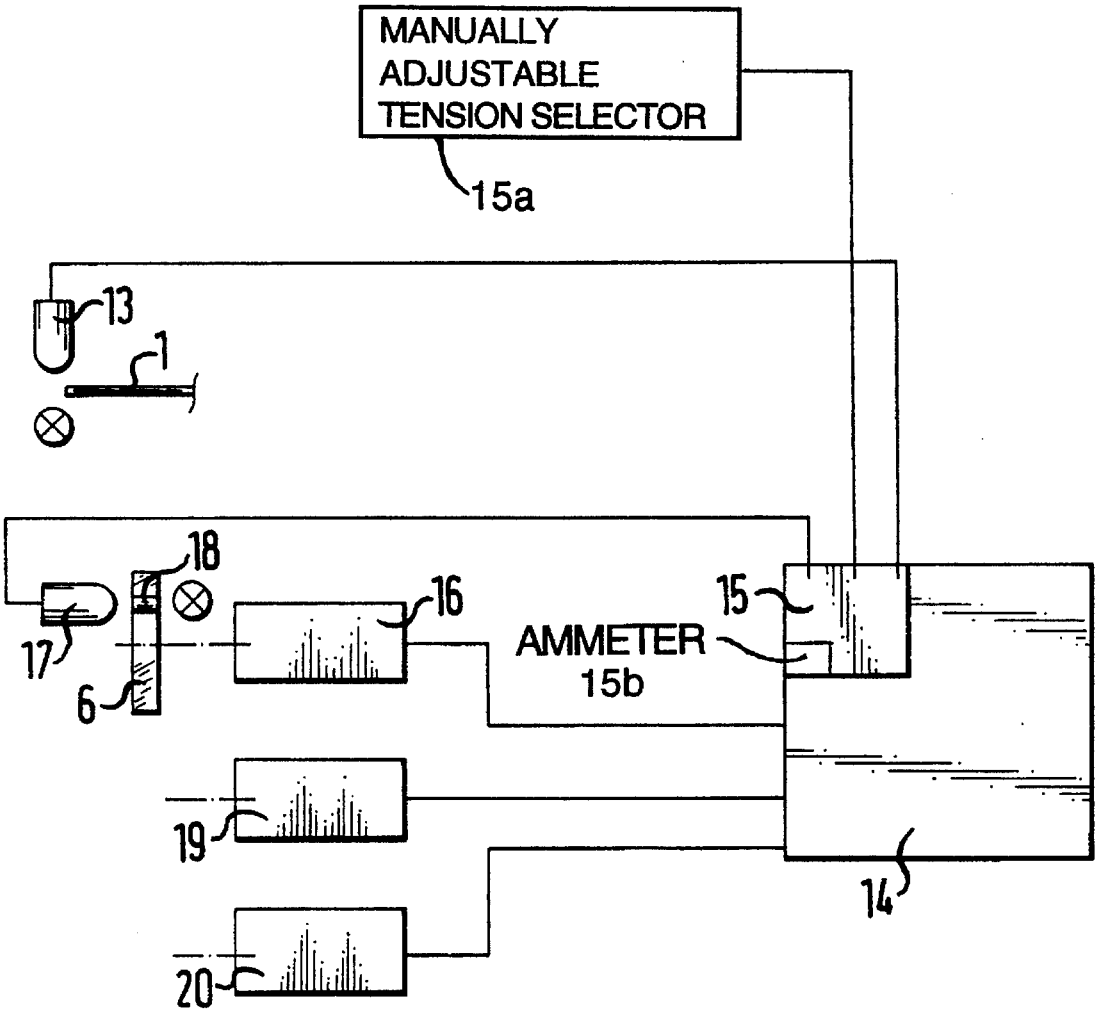
FIG. 2 is a block diagram illustrating the motors, their power supply, and their controls.

Strap 1 is extracted from a reel 2. The leader is threaded into a track 3 by hand until it arrives in the nip 4 between strap-feed wheels 5 and 6. An unillustrated spring gently forces wheel 5 against wheel 6. At least one of the wheels is driven. The wheels feed the leader into a guide 7. Once through guide 7, the leader is intercepted by a strap-stretcher wheel 8 and introduced into a track 10, represented by a solid line in FIG. 1, that loops entirely around a package 11. Strap 1 continues in the direction indicated by the arrow 12 until it completely occupies track 10. The wheel 8 is loosely surrounded by a strap guide 9 having one end opening into the track 10.

Strap-feed wheel 6 rotates rapidly, and track 10 is soon completely occupied by strap. Just before arriving at the end or entry point, the leader travels past a sensor 13 in the form for example of a light barrier, its beam interrupted by strap 1.

Sensor 13 notifies a data processor 15 that the leader has passed. Processor 15 is accommodated in and controls a frequency converter 14. The processor instructs converter 14 to considerably decrease the frequency of the electricity powering a motor 16 that drives the strap feed. A distance gauge comprising a light barrier 17 that shines through several perforations 18 distributed around a circle in strap-feed wheel 6 is now engaged. A pulse is transmitted to processor 15 every time the beam from light barrier 17 penetrates one of the perforations 18 in the rotating wheel. The intervals of arc can be much finer if the gaps between the cogs in one of the wheels in the drive are exploited instead of perforations 18 for the light to shine through.

Processor 15 is programmed to decrease the frequency one increment subsequent to every pulse and to turn the electricity entirely off subsequent to a specific number of pulses. To ensure sufficient torque just before the electricity is turned off, the potential and hence the current is increased at the frequencies for purposes of compensation. A manually adjustable terminal strap-tension selector 15a may be connected to the processor 15.

The leader is clamped tight once strap-feed motor 16 is off. Frequency converter 14 then supplies motor 16 with a rotary current of an opposite phase shift, reversing the motor. Converter 14, or processor 15, contains an ammeter 15*b*. An increase in the current in motor 16 to a specific level informs processor 15 that the motor is about to stop. Once the specific level has been attained, the processor turns strap-stretcher motor 19 on and decreases the current flowing through strap-feed motor 16. Strap 1 is stretched to a prescribed tension. The prescribed tension differs with the package 11 and is entered by the operator. A specific converter frequency is associated with every level of tension in strap 1. If increasing the frequency does not adequately increase the tension in the strap or the produce the requisite torque in the motor, the potential can be increased further.

Strap-feed motor 16 and strap-stretcher motor 19 are both turned off once the induced current or the corresponding tension in strap 1 has attained a certain level, and the motor 20 that drives strap-end fastener 22 is turned on.

Strap-end fastener 22 includes a strap cutter. Strap-end fastener motor 20 is turned off by an unillustrated inductive proximity switch, triggered by the fastener or cutter.

Once they have been turned off, motors 16 and 19 are allowed to briefly run backwards at low frequency. This operation is intended to straighten out the raw-edged leader, which has been bent by the fastening and cutting procedures. It is necessary in order to ensure precise alignment for the leader to be retracted past a strap aligner 21 and immediately stop.

Light barrier 17 transmits a specific number of pulses to processor 15 to ensure precise retraction on the part of the leader.

The present invention employs synchronous three-phase motors of the type commercially available for use with 50-Hz power. The motors outputs can be increased by briefly operation them at frequencies of up to 70 Hz and even a excess potential.

The invention is not limited to use with a sensor like sensor 13 and a light barrier like light barrier 17. Any known sensor and distance gauge can be employed.

The invention is particularly wear-resistant when employed with three motors. It is of course possible to eliminate one of the motors by coupling one of the others to two strap-handling mechanisms. In this event at least strap-feed motor 16 should be controlled by way of sensor 13, light barrier 17, and processor 15.

We claim:

1. An article strapping arrangement comprising: a strap track looped around an article to be strapped; three motor-driven units mounted on said strap track and comprising a strap feed, a strap stretcher, and a strap-end fastener; said strap feed having at least two spring-loaded wheels; each of said wheels being forced against one side of a strap; a reversible strap-feed motor connected to said strap feed for driving said strap feed; a strap-stretcher wheel between said strap feed and said strap track for intercepting a leading portion of a strap and introducing said leading portion into said track; a strap guide partly loosely surrounding said strap-stretcher wheel; said guide having one end opening into said track; a strap-stretcher motor connected to said strap-stretcher wheel, said strap-stretcher motor and said strap-feed motor being asynchronous three-phase motors; a frequency converter connected to said motors for supplying said motors with electricity of varying frequency and potential; control means in said frequency converter for controlling said converter; a manually adjustable terminal strap-tension selector connected to said control means for selecting a specific terminal strap tension; said strap-stretcher motor being operated at an electrical frequency varying in accordance with said specific terminal strap tension, said strap-feed motor being operated with electricity varying in accordance with frequency and potential form said frequency converter.

2. An arrangement as defined in claim 1, including sensor means upstream of said strap-end fastener connected to said control means and sensing said leading portion of a strap, said strap-feed motor being operated by electricity with frequency decreased incrementally when said leading portion of the strap has passed said sensor means according to how far said leading portion has traveled, said control means receiving a signal from said sensor when a specific distance has been traveled.

3. An arrangement as defined in claim 2, including a light barrier for transmitting said signal, said light barrier shining through gaps between teeth on one of said wheels of said strap-feed drive.

4. An arrangement as defined in claim 2, including a light barrier for transmitting said signal; one of said wheels of said strap-feed drive having perforations distributed around a circle in said strap-feed wheel, said light barrier shining through said perforations.

5. An arrangement as defined in claim 2, including an inductive proximity switch positioned substantially above a gear in said strap-feed drive for emitting said signal.

6. An arrangement as defined in claim 1, wherein said electricity can operate said strap-feed motor in reverse, said control means turning on said strap stretcher motor and turning off said strap feed motor when current of said electricity attains a specific level while the strap is wrapped around the article.

7. An arrangement as defined in claim 1, wherein said strap has a raw-edged strap leader retracted slightly past a strap aligner.

8. An arrangement as defined in claim 1, including means for measuring electrical current in said electricity, said control means being programmed to decrease the frequency of the electricity operating said strap-stretcher motor at least once near the end of a strap-stretching procedure, said frequency being decreased when said electrical current is at a specific level.

9. An arrangement as defined in claim 8, wherein said electricity has a potential that is increased when the frequency is decreased.

10. An arrangement as defined in claim 1, including a strap-end fastener motor connected to said frequency converter and controlled by said control means by frequency variation.

11. An arrangement as defined in claim 10, wherein strap-feed motor, said strap-stretcher motor, and said strap-end fastener motor are operated by electricity with frequencies exceeding 60 Hz as well as with frequencies below 60 Hz frequencies.

12. An arrangement as defined in claim 10, wherein said control means stores all parameters associated with various terminal strap tensions, said strap-stretcher motor being turned off and said strap-end fastener motor being turned on when a specific tension is attained as indicated by said electrical frequency varying in accordance with said strap tension.

13. An arrangement as defined in claim 1, wherein said strap-stretcher motor is operated by electricity with frequency and potential varied according to said predetermined terminal strap tension.

14. An arrangement as defined in claim 1, wherein said electricity operating the motors has power that is initially low and rapidly increased.

15. An arrangement as defined in claim 1, wherein said strap-end fastener motor is operated by electricity of varying high frequencies when ends of the strap are being fastened together.

16. An arrangement as defined in claim 1, wherein said control means polls a component emitting said signal, said control means turning off said strap-stretcher motor once the strap has been stretched and said control means receives no further signals for a predetermined length of time.

* * * * *